US007486194B2

(12) United States Patent
Stanners et al.

(10) Patent No.: US 7,486,194 B2
(45) Date of Patent: Feb. 3, 2009

(54) PERSONAL ALARM SYSTEM FOR OBTAINING ASSISTANCE FROM REMOTE RECIPIENTS

(75) Inventors: Sydney Devlin Stanners, Sidney (CA); Kam Keung Fung, Causeway Bay (HK)

(73) Assignee: Sydney Devlin Stanners, Sidney, British Colmubia (CA)

( * ) Notice: Subject to any disclaimer, the term of this patent is extended or adjusted under 35 U.S.C. 154(b) by 543 days.

(21) Appl. No.: 10/387,121

(22) Filed: Mar. 11, 2003

(65) Prior Publication Data

US 2003/0231115 A1 Dec. 18, 2003

Related U.S. Application Data

(60) Provisional application No. 60/363,280, filed on Mar. 12, 2002.

(51) Int. Cl.
*G08B 13/00* (2006.01)

(52) U.S. Cl. ..... 340/574; 340/539.11; 340/539.13; 340/573.1; 340/693.5; 379/37; 455/404.1

(58) Field of Classification Search ..... 340/574, 340/539.11–539.13, 539.26, 573.1, 693.5; 379/37–42, 45, 51; 455/404.1, 404.2
See application file for complete search history.

(56) References Cited

U.S. PATENT DOCUMENTS 4,491,970 A * 1/1985 LaWhite et al. ..... 455/100
5,195,126 A * 3/1993 Carrier et al. ..... 379/45
5,305,370 A 4/1994 Kearns et al. ..... 379/45
5,568,535 A * 10/1996 Sheffer et al. ..... 379/39
5,652,570 A * 7/1997 Lepkofker ..... 340/574
5,712,619 A 1/1998 Simkin ..... 340/539
5,742,233 A * 4/1998 Hoffman et al. ..... 340/573.1
5,771,001 A 6/1998 Cobb ..... 340/573
5,838,237 A 11/1998 Revell et al. ..... 340/573
5,971,921 A 10/1999 Timbel ..... 600/300
6,014,555 A 1/2000 Tendler ..... 455/404
6,072,396 A * 6/2000 Gaukel ..... 340/539.13
6,340,928 B1 1/2002 McCurdy ..... 340/436
6,535,127 B1 * 3/2003 Taylor ..... 340/573.1
6,636,732 B1 * 10/2003 Boling et al. ..... 455/404.1
6,807,564 B1 * 10/2004 Zellner et al. ..... 379/37
2001/0026223 A1 10/2001 Menard et al.

FOREIGN PATENT DOCUMENTS

CN 1336066 A 2/2002
WO WO 01/52517 7/2001
WO WO 0178032 A1 * 10/2001
WO WO 03/024322 3/2003

OTHER PUBLICATIONS

EPO Communication, Application No. 03 706 193.4, Apr. 15, 2008, 5 pp.

* cited by examiner

*Primary Examiner*—Thomas J Mullen
(74) *Attorney, Agent, or Firm*—MacPherson Kwok Chen & Heid LLP

(57) ABSTRACT

The present invention provides a personal alarm system including a communication device for transmitting a signal to a recipient such as a signal monitoring center or rescue or other emergency authorities. An interface module, including a user-programmable memory and a user interface, controls the communication device. A triggering key is used to activate the interface module in the case of an emergency, thereby causing the communication device to transmit a signal to the recipient.

43 Claims, 3 Drawing Sheets

PERSONAL ALARM SYSTEM FOR OBTAINING ASSISTANCE FROM REMOTE RECIPIENTS

CROSS-REFERENCE TO RELATED APPLICATIONS

The present invention derives priority from provisional patent application No. 60/363,280 filed on Mar. 12, 2002.

FIELD OF THE INVENTION

The present invention relates to alarm systems for individuals. In particular, the invention provides a system which sends an alarm to a remote location responsive to pre-programmed parameters with respect to alarm conditions being met or failing to be met, delivery address and method of delivery and alarm message content, pre-programming being done by the user at the interface of the system, which is preferably at a hand-held remote unit provided with an interface module.

BACKGROUND OF THE INVENTION

In recent years, employers, employees, trade unions, and others have become increasingly concerned about the problem of violence to staff working in direct contact with the public. Employees who work alone in this capacity are considered to be in high-risk occupations. Violence in the workplace has been an escalating problem in both the private and public sectors.

In a July 1998 report on workplace violence published by the International Labor Organization, Canada ranked $4^{th}$ worldwide for workplace violence that victimizes women and $5^{th}$ for men. The US Center for Disease Control announced as early as 1998 that workplace violence had reached epidemic proportions as reported in the Houston Business Review Mar. 15, 2002 print edition. Workers involved in violent confrontations often suffer severe psychological and physical trauma. Some of these attacks result in hospitalization of the worker and in some cases deaths have occurred. Women are statistically at considerably more risk than their male co-workers. Women working alone often additionally become victims of sexual assault.

Systems disclosed in the prior art have provided various forms of personal alarms designed to ward off and deter attackers or potential attackers. Such systems may have an audible alarm meant to draw attention to the victim or the potential victim. However, such systems are unsuitable or unusable for a large variety of different work environments as these systems are audible and therefore detectable by the perpetrator. Further, such systems are of limited benefit to workers and other users who may need a personal alarm which notifies remote parties.

Related prior art systems enable users to contact the 911 emergency number by pushing a single button on a cell phone or radio. These systems pre-suppose that the aggressor will allow the threatened user to complete the call and may escalate the degree of violence or hasten a hands-on attack if the alarm is used in plain view of the aggressor.

Other prior art systems, such as the alarm system taught in U.S. Pat. No. 5,971,921, contact a monitoring center through a receiver/caller unit. However, such receiver/caller units are stationary units designed to be used exclusively with a telephone line which limits the system's application for mobile individuals.

Still other prior art systems, such as those found in U.S. Pat. Nos. 5,712,619 and 5,838,237, teach personal alarms which are capable of transmitting GPS information to law enforcement or other emerging personnel along with an emergency signal. Neither of these prior art systems control or use existing communication devices such as cell phones and therefore introduce additional costs by requiring cellular or radio transmitting means.

SUMMARY OF THE INVENTION

There is an unfulfilled need to provide a mobile personal alarm system which is suitable for a large variety of work environments and capable of contacting authorities or other resources, possibly silently, and either with a one-way signal or by two-way communications, where the authorities or other resources may be remote.

In response to the threat of workplace violence, which is not addressed in the prior art, the present personal alarm system has been conceived. The present system provides a "lifeline" which has the potential to greatly improve the personal safety of workers in a variety of different occupations. Public nurses, home care workers, real estate agents and others who are required to meet with clients or strangers in their homes or other similar (secluded or remote) locations will benefit from the protection provided by the present system. In addition, anyone needing a system which contacts a monitoring center or the authorities in case of an emergency will also benefit from the present system.

In one embodiment of the invention, a personal alarm system includes a communication device for transmitting a signal to a recipient such as a signal monitoring center or the authorities and an interface module which has a user-programmable memory and a user interface for controlling the communication device. The system further includes a triggering key for transmitting a triggering signal to the interface module which will then in turn cause the communication device to transmit a signal to the recipient.

In another more specific embodiment of the invention, a personal alarm system includes a cell phone for transmitting a signal to at least one recipient and an interface module operatively connected to the cell phone for controlling the cell phone. The interface module again includes a user-programmable memory and a user interface, used for programming and storing the recipient's contact information and situational information. Further, the system includes at least one triggering key for transmitting a triggering signal to the interface module which will then in turn cause the communication device to transmit a signal to the recipient.

DETAILED DESCRIPTION OF THE INVENTION

Exemplary embodiments of a personal alarm system 100 will be described with reference to the figures. System 100 includes a triggering key 10, an interface module 20 and a communication device 40 as more particularly described below. Interface module 20 may be either integral with or otherwise operatively connected to communication device 40. Further, triggering key 10 may be integral with or otherwise operatively connected to interface module 20.

Figure 1:
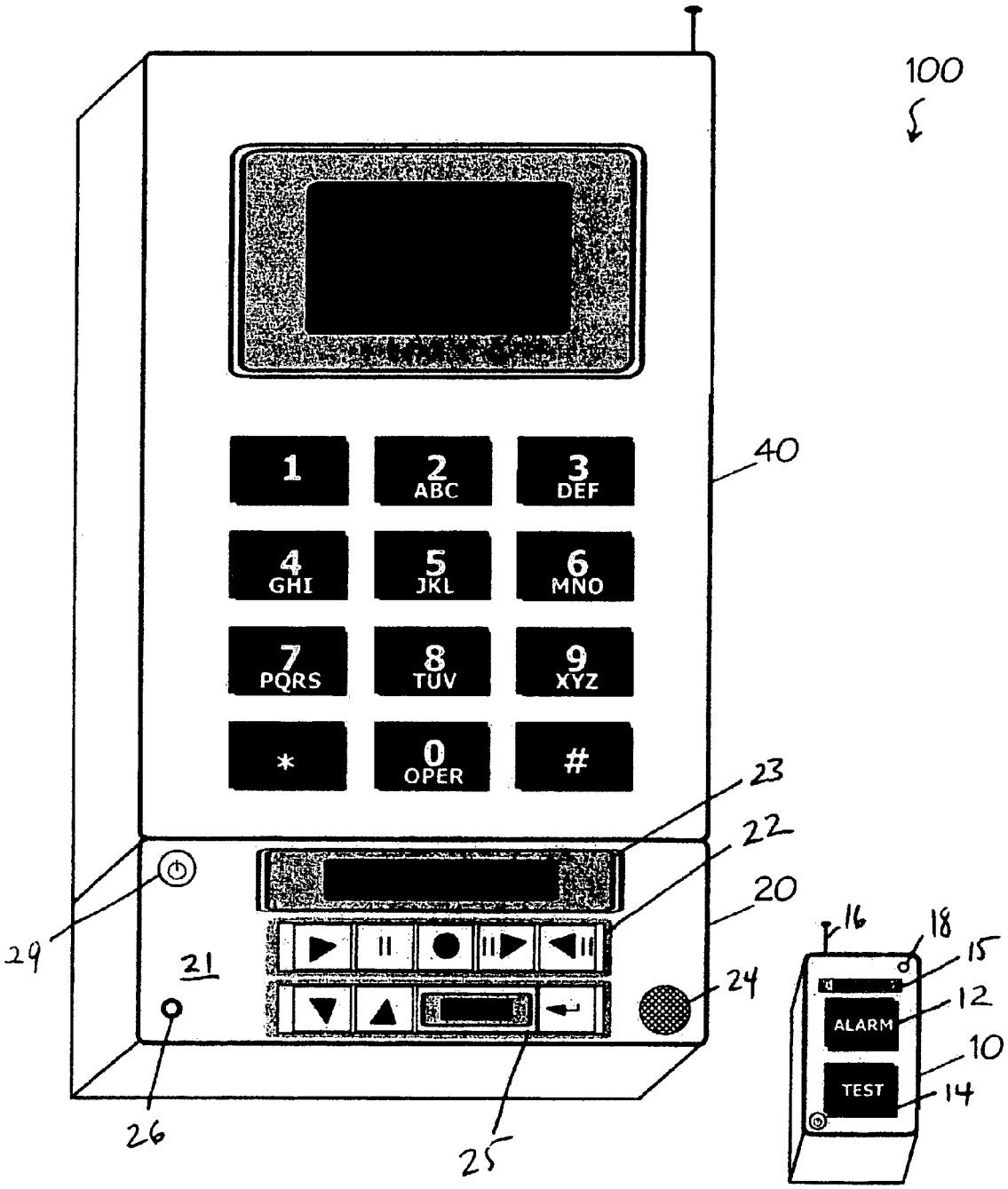
FIG. 1 is a perspective view of an exemplary monitoring system in accordance with the invention.
Figure 2:
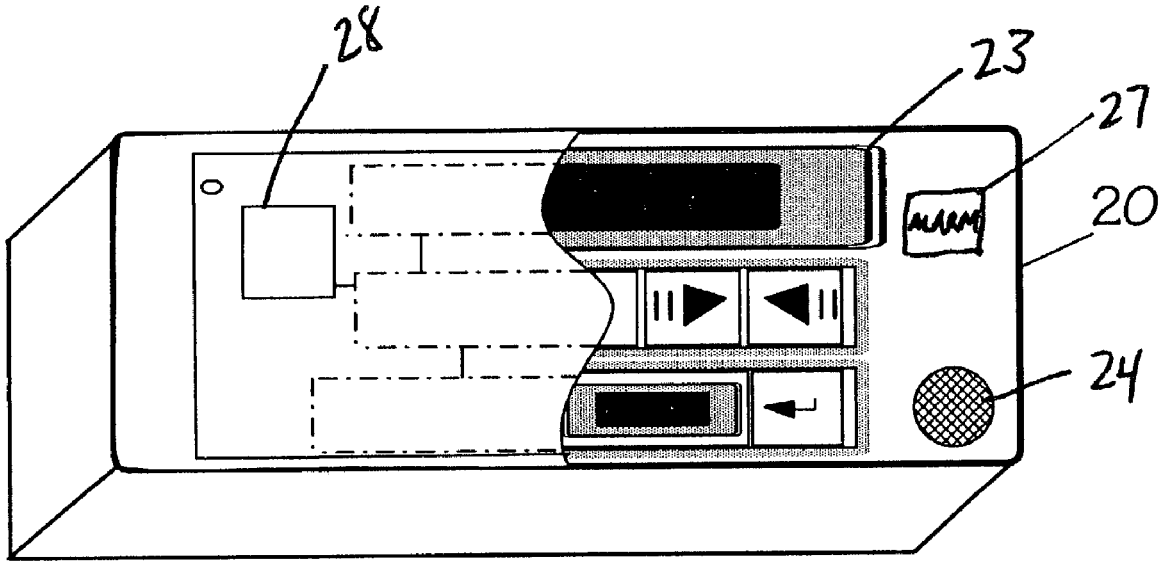
FIG. 2 is a perspective view and cut-away of an interface module in accordance with the invention.

In a preferred embodiment, the user records a message or data in the system in a message or data mailbox or via the user interface 21 provided by interface module 20, for example to identify the user's location and circumstances. For example, in the case of a social worker visiting a client, such message or data may include the client's name, address, telephone number and the time as well as any other pertinent information such as the client's history of drug abuse or mental disorder and the user's medical history, any or all of which might be by way of pre-arranged code or symbol. The user then programs the system via the interface module 20 with specific information, including a rule or rules which determine the system's invocation of a transmission, the address or desired destination of the transmission, and the content of the transmission, whether it is a distress call with address and other data intended for receipt by a signal monitoring center (for example), or it is "man down" information with inferred location data, for transmission to appropriate rescue or other authorities; and such information is stored in user-programmable memory 28 of the system as best shown in FIG. 2.

If rules for invocation of the transmission are met, for example if the user becomes involved in a predicted circumstance like a violent incident (such as an attack or threatened attack by the client in the case of the social worker) then the user may initiate a rescue by triggering the invocation of the transmission of the data, either with or without the knowledge of the client by activating triggering key 10.

Upon activation, triggering key 10 transmits or sends a triggering signal to interface module 20 which causes communication device 40 to send a pre-determined signal to the pre-programmed recipient, whether signal monitoring center or police, ambulance or other authorities who may provide assistance. If the signal is sent to a monitoring center, but not to authorities, then that monitoring center may also be instructed (whether pre-arranged or as part of the data signal transmitted) to relay a message or data to appropriate authorities who can then take steps to assist the user. The signal may include a message or data recorded by the user or may simply signal a monitoring center or other person or authority to access the message data mailbox or data store to retrieve the message or data recorded by the user.

In a more specific embodiment, presented here by way of illustrating one instance of the overall operation of the present system, the user stores an analog or digital message or data in a predetermined message or data mailbox or store which is known and accessible to the system, or to a signal monitoring center or the authorities in the event of an emergency. Interface module 20 may include a microphone 26, a digital or tape voice recorder 23 and associated circuitry (not shown) for recording a message or data to be sent to a monitoring center or the authorities in case of an emergency. Using the features of the interface module's user interface 21 and more particularly programming keys 25, the user programs at least one monitoring center's or authorities' contact information.

If one of the rules in the system for invocation of a transmission is met (that is, there is an attack or emergency situation), the user invokes a transmission for help by activating triggering key 10 by either turning on a switch 13 or pushing or squeezing a button 12. Triggering key 10 includes a power supply (not shown), a radio frequency transmitter (not shown) and an antenna 16 for radiating a short range radio frequency signal to interface module 20. Workers skilled in the art will recognize that other modes of transmitting a signal from triggering key 10 to signify that the user wishes to invoke a transmission. This signal is received by a receiver (not shown) included in interface module 20.

Upon receiving the signal from triggering key 10, interface module 20 activates communication device 40 which includes detecting the on/off status of communication device 40, turning on communication device 40 if it is in the off state and causing communication device 40 to transmit a signal to at least one pre determined recipient (or recipient address) such as a monitoring center or rescue authority.

The signal comprises sufficient data such that the signal's recipient, for example personnel at the monitoring center or rescue authorities, knows that there is a situation of which the user desires that the recipient becomes aware, such as an emergency. The signal may contain information related to the situation, such as a pre-recorded voice message of the user, and/or date, the user's location, GPS data, or other data, or a pre-arranged signal or symbol with meaning to the recipient in the circumstance of receipt of the transmitted data, or in other instances, the recipient (such as a monitoring center or rescue authorities) may obtain useful information by accessing a pre-recorded message or data from a mailbox set up by the user at a location other than interface module 20 (for example, a web-page, telephone answering service or other remote mailbox). Once the signal is sent to the recipient (e.g. monitoring center or the rescue authorities), communication device 40 may be either deactivated, left in an activated state for receiving incoming signals or communication device 40 may send a signal to other recipients as determined by the pre-determined programming of interface module 20.

Various embodiments of communication device 40, interface module 20 and triggering key 10 are available, making this personal alarm system very flexible and easily adapted for many work environments and other situations. Some further embodiments are described below.

Communication Device

Communication device 40 may be a car or mobile cell phone, a radio, a beacon, a personal data assistant with cellular capabilities, a SMS (Short Message Service) system, a Bluetooth™ or other RF device or any other device capable of being controlled by interface module 20 and transmitting a signal to a recipient, be it a monitoring center, rescue authority or other recipient.

In embodiments where communication device 40 is a cell phone or a personal digital assistant (PDA) with cellular or radio capabilities, interface module 20 connects to the cell phone's or PDA's interface connector, which may be by radio frequency, infrared, wireline or other facility, and which is a logical connector and not necessarily a physical connector (not shown) which allows control of the cell phone's or PDA's internal functions by interface module 20.

Alternatively, the cell phone or PDA may include all or part of the functionality of interface module 20 in which case the cell phone's or PDA's existing features and hardware would perform some of all of the necessary interface module 20 functions. For example, rather than having a separate microphone, interface module 20 could use the cell phone's or PDA's microphone and the cell phone's or PDA's number pad could be used for programming keys 25.

Communication device 40 and interface module 20 may be conveniently carried in a briefcase, purse, pocket, left in the hall closet in the worker's coat pocket or clipped to a belt and may, in any event, be conveniently left in plain view of the client.

Interface Module

The interface module's user interface 21 may include various keys or buttons 25 for programming information into interface module 20 which programmed information is then stored in user-programmed memory 28 such that when a transmission to a recipient is invoked, interface module 20 will cause communication device 40 to transmit the correct signal or content to a correct recipient or recipients. In one embodiment, interface module 20 includes a keyboard for entering information at pre-programmed prompts. In another embodiment, interface module 20 includes a voice-programmable user interface. In yet another embodiment, interface module 20 includes handwriting input and recognition. Interface module 20 may include a digital or tape voice or sound recorder 23 which conveniently includes microphone 26 and includes familiar function keys 22 such as play, rewind, pause and erase for storing a message or data. Recorder 23 may further include more robust programming features. For example, recorder 23 may be programmed to ensure that successively recorded messages or data delete previously recorded messages or data to ensure that the most current (and therefore correct) message or data is available or transmitted to the monitoring center or authorities.

Interface module 20, after causing communication device 40 to transmit the recorded signal or message or data to the recipient, for example a monitoring center, may be programmed to maintain communication between the recipient and communication device 40 to allow the monitoring center to communicate through speaker 24 with the user or other parties involved in the emergency situation, such as an assailant or on-scene rescuers or helpers.

Interface module 20 and triggering key 10 may include transceivers (not shown) for allowing a user to determine if triggering key 10 is within range to activate interface module 20. In this embodiment, triggering key 10 includes a test button 14. Upon activation of the test button 14, triggering key 10 sends a coded signal to the transceiver housed in interface module 20. If interface module 20 receives the coded signal indicating that triggering key 10 is within activation range then interface module 20 returns a signal to triggering key 10 which is received by the transceiver in triggering key 10. Receipt of a return signal by triggering key 10 may then cause triggering key 10 to vibrate or activate an alternate indicator such as a light 18 or a sound.

As is well known to those skilled in the art, there are many available technologies which may be used to wirelessly send a signal from triggering key 10 to interface module 20. For example, by not by limitation, interface module 20 and triggering key 10 may include Bluetooth™, radio frequency (RF), infrared or WiFi technology for wirelessly receiving and sending signals.

Interface module 20 may use power on-board communication device 40 as its power supply or may include an independent power supply (not shown). In embodiments where interface module 20 includes a power supply, interface module 20 will also include an on/off means 29. In either of these embodiments, interface module 20 may further include a backup power supply (not shown) for providing sufficient power to operate interface module 20 and for activating and controlling communication device 40 and could include backup power for the communication device in case that device had run out of battery power or was unpowered.

In addition to or instead of being remotely controlled, interface module 20 may include an activation button or switch 27 which, when activated, conveniently activates interface module 20 in the same way as if interface module 20 had received a signal from a triggering key 10. In a further embodiment, a push wire including an activation button (not shown) suitable for wearing beneath clothing may be attached to the activation button 27 for silently triggering interface module 20 to silently contact the pre-programmed recipient through communication device 40. This embodiment also allows the user to conceal the present system in a brief case or purse or other carried item and readily activate the present system by depressing the push wire's button which may be concealed by the brief case handle or the purse's carry strap.

In another embodiment, the system may use a global positioning system (GPS) to provide the user's exact location as a new and additional part of the pre-programmed message or data transmitted to the recipient. More specifically, interface module 20 or communication device 40 may include a GPS chip. When activated, interface module 20 or communication device 40 can receive latitude and longitude coordinates from the GPS and communication device 40 will then provide these coordinates along with the pre-determined signal to the pre-programmed recipient (call monitoring center or rescue authorities).

Triggering Key

In another embodiment, the personal alarm system is automatically activated at preprogrammed intervals unless triggering key 10 is activated. In this embodiment, a rule of the system for invocation of a transmission is met by the failure of a triggering key action within a preset time interval, so that interface module 20 is automatically triggered if the user fails to act by activating triggering key 10 within programmed time intervals. This embodiment is convenient for individuals who are in situations where they would have difficulty triggering an alarm in the event of an accident (such as a worker in a situation where the worker could be rendered unconscious or a senior citizen who may be unable to get to an alarm in an emergency). In this further embodiment, triggering key 10 includes a programmable timer (not shown) and may also include a reminder indicator 15 or a vibration mechanism (not shown) which may indicate to the user that the system will invoke a transmission unless triggering key 10 is activated by pressing button 12, or turning off switch 13. In this embodiment, triggering key 10 is preferably designed to be easily carried by or attached to the user.

Those skilled in the art will realize that many of the functions and embodiments available for interface module 20 may be included in triggering key 10 as interface module 20 and triggering key 10 may be combined and as interface module 20 and triggering key 10 can communicate. For example, triggering key 10 may include recorder 23, microphone 26 and user programmable memory 28 for recording a message or data which is subsequently transmitted to interface module 20 when triggering key 10 sends an activation signal to interface module 20.

Triggering key 10 may encode the signal sent to interface module 20 which is subsequently decoded by interface module 20 for ensuring secure transmissions between triggering key 10 and interface module 20.

Triggering key 10 may include a switch (not shown) which is activated when triggering key 10 reaches a predetermined angle. This enables triggering key 10 to be activated automatically when, for example, the user reaches a prone or semi prone position to provide a "man down" signaling event. In another embodiment, sensors for substances like $H_2S$ and $H_2O$ or other indicators of dangerous or unexpected environmental situations can be on board the system, and provide alternative triggering means, dependent upon pre-selected programming. When the switches' circuit is closed, triggering key 10 sends an activation signal to interface module 20.

Figure 3:
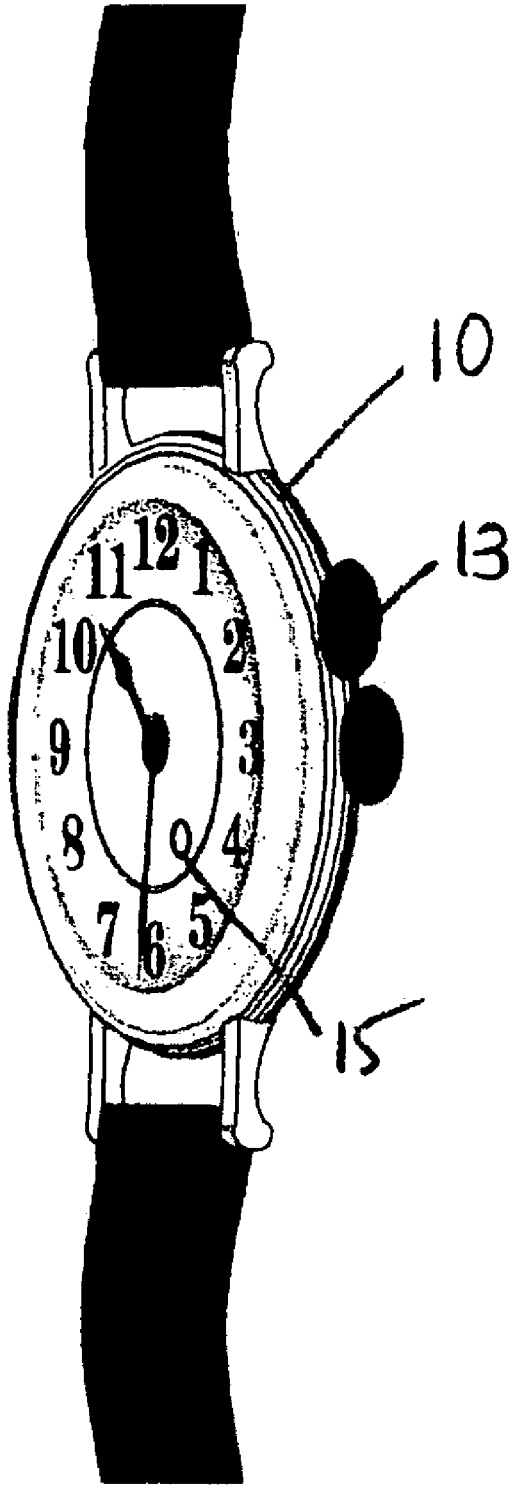
FIG. 3 is a perspective view of an embodiment of a triggering key in accordance with the invention.

Triggering key 10 may be conveniently worn beneath clothing or on the user's wrist as shown in FIG. 3, as part of the user's key chain or may be disguised as a commonly worn accessory such as jewelry for concealing triggering key 10 from a potential assailant. For further convenience, triggering key 10 may include two or more triggering keys which are readily available in different places to allow a user to conveniently activate interface module 20 in various circumstances without being restricted to one triggering key.

What is claimed is:

1. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the interface module and the communication device respectively include a radio signal transmitter and a radio signal receiver for allowing the interface module to control the communication device.

2. A personal alarm system as in claim 1 wherein the communication device further includes a cell phone for transmitting the signal to the recipient.

3. A personal alarm system as in claim 1 wherein the communication device further includes a radio signal transmitter for transmitting the signal to the recipient as a radio signal.

4. A personal alarm system as in claim 1 wherein the communication device further includes a beacon for transmitting the signal to the recipient as a beacon.

5. A personal alarm system as in claim 1 wherein the communication device further includes a personal digital assistant and the communication device further includes a radio signal transmitter for transmitting the signal to the recipient.

6. A personal alarm system as in claim 1 wherein the communication device further includes a personal digital assistant including cellular transmitting capabilities for transmitting the signal to the recipient.

7. A personal alarm system as in claim 1 wherein the communication device further includes a SMS (Short Message Service) system for transmitting the signal to the recipient.

8. A personal alarm system as in claim 1 wherein the communication device includes the interface module for invoking all of the interface module functions in the communication device.

9. A personal alarm system as in claim 1 wherein the communication device includes GPS capabilities for including locator information in the signal transmitted to the recipient.

10. A personal alarm system as in claim 1 wherein the user interface is programmed to cause the communication device to transmit the signal to at least one additional recipient.

11. A personal alarm system as in claim 1 wherein the user interface includes at least one programming key for entering the recipient's contact information.

12. A personal alarm system as in claim 1 wherein the user interface includes at least one programming key for entering the recipient's contact information and the contact information for a further recipient.

13. A personal alarm system as in claim 1 wherein the user interface includes a microphone and a recorder for storing a voice message for transmission by the communication device to the recipient, the message stored in the user-programmable memory.

14. A personal alarm system as in claim 1 wherein the interface module includes a backup power supply for providing sufficient power to the interface module and the communication device to transmit a signal to the recipient.

15. A personal alarm system as in claim 1 wherein the interface module includes GPS capabilities for transmitting locator information to the communication device for transmission to a recipient with the signal.

16. A personal alarm system as in claim 1 wherein the triggering key includes a timer for automatically triggering a transmission to the recipient if the user does not activate the triggering key.

17. A personal alarm system as in claim 1 wherein the triggering key includes a user interface for programming the timer for various time intervals.

18. A personal alarm system as in claim 1 wherein the triggering key includes sensors for detecting substances and a switch for automatically triggering the triggering key upon detection by the sensors of the substances.

19. A personal alarm system as in claim 18 where the detectable substances are substances which would be deleterious to the user when present in the user's local environment.

20. A personal alarm system as in claim 1 wherein the triggering key includes an attitude sensor for automatically triggering the interface module when a user wearing the triggering key is prone or semi-prone.

21. A personal alarm system as in claim 1 wherein the triggering key is included within a wristwatch.

22. A personal alarm system as in claim 1 wherein the triggering key is included within jewelry worn by the user.

23. A personal alarm system for transmitting a signal from a user to a recipient comprising:

a communication device for transmitting the signal to the recipient;

an interface module in operative communication with the communication device for controlling the communication device, the interface module having a user-programmable memory and a user interface for programming in the user's identity and a request for the recipient to look up particular information or data; and a triggering key in operative communication with the interface module for activating the interface module.

24. A personal alarm system as in claim 23 wherein the user interface is used to add addressing information to the user-programmable memory to be sent as part of the signal to be transmitted from the communication device to the recipient for advising the recipient where to look up the particular information or data.

25. A personal alarm system as in claim 23 wherein the communication device includes the interface module for invoking all of the interface module functions in the communication device.

26. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the interface module and the communication device respectively include a cellular signal transmitter and a cellular signal receiver for allowing the interface module to control the communication device.

27. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the interface module and the communication device respectively include a Bluetooth™ transmitter and a Bluetooth™ receiver for allowing the interface module to control the communication device.

28. A personal alarm system. as in claim 27 wherein the communication device includes the interface module for invoking all of the interface module functions in the communication device.

29. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the interface module and the communication device respectively include an infrared transmitter and an infrared receiver for allowing the interface module to control the communication device.

30. A personal alarm system comprising:

a communication device for transmitting a signal to a recipient;

an interface module in operative communication with the communication device for controlling the communication device, the interface module having a user-programmable memory and user interface; and a triggering key in operative communication with the interface module for activating the interface module, wherein the interface module controls the communication device by first determining the communication device's on/off state, switching on the communication device if necessary and then causing the communication device to transmit a signal to the recipient.

31. A personal alarm system for transmitting a signal from a user to a recipient comprising:

a communication device for transmitting the signal to the recipient;

an interface module in operative communication with the communication device for controlling the communication device and for providing data to be included in the signal, the interface module having a user-programmable memory and a user interface for allowing the user to program user-defined data into the interface module for storage in the user-programmable memory, the user interface including at least one programming key for entering the recipient's contact information and for programming rules for determining when the interface module will control the communication device; and a triggering key in operative communication with the interface module for activating the interface module.

32. A personal alarm system comprising:

a communication device for transmitting a signal to a recipient;

an interface module in operative communication with the communication device for controlling the communication device, the interface module having a user-programmable memory and a user interface;

a triggering key in operative communication with the interface module for activating the interface module; and a data store at a location accessible by the recipient for storing user data for the recipient to retrieve upon receiving the signal, the signal programmed by the user using the user interface to include addressing data or information pointing to the data store location.

33. A personal alarm system as in claim 32 wherein the triggering key includes a button for activating the interface module.

34. A personal alarm system as in claim 33 wherein the triggering key includes at least one additional button for activating the interface module.

35. A personal alarm system as in claim 32 wherein the communication device includes the interface module for invoking all of the interface module functions in the communication device.

36. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the triggering key and the interface module respectively include a cellular signal transmitter and a cellular signal receiver for allowing the triggering key to remotely activate the interface module.

37. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the triggering key and the interface module respectively include a radio signal transmitter and a radio signal receiver for allowing the triggering key to remotely activate the interface module.

38. A personal alarm system as in claim 37 wherein the communication device includes the interface module for invoking all of the interface module functions in the communication device.

39. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the triggering key and the interface module respectively include a Bluetooth™ transmitter and a Bluetooth™ receiver for allowing the triggering key to remotely activate the interface module.

40. A personal alarm system as in claim 39 wherein the communication device includes the interface module for invoking all of the interface module functions in the communication device.

41. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the triggering key and the interface module respectively include an infrared transmitter and an infrared receiver for allowing the triggering key to remotely activate the interface module.

42. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the interface module and the triggering key each include transceivers and the triggering key includes a test button for allowing a user to send a test signal between the interface module and the triggering key for determining if the interface module is within an effective range of the triggering key.

43. A personal alarm system comprising:

a communication device for transmitting a signal to a recipient;

an interface module in operative communication with the communication device for controlling the communication device, the interface module having a user-programmable memory and a user interface; and a triggering key in operative communication with the interface module for activating the interface module, wherein the triggering key includes an encoder for securely encoding a triggering signal prior to sending it to the interface module and the interface module includes a decoder for decoding the encoded triggering signal.

* * * * *